US005729862A

United States Patent [19]

Ringler et al.

[11] Patent Number: 5,729,862

[45] Date of Patent: Mar. 24, 1998

[54] TEXTILE CLEANING MACHINE WITH HIGH-EFFICIENCY AIR CIRCULATION

[75] Inventors: Walter A. Ringler, Monroe; Rayford W. Timms, Matthews, both of N.C.

[73] Assignee: Luwa Bahnson, Inc., Charlotte, N.C.

[21] Appl. No.: 569,650

[22] Filed: Dec. 8, 1995

[51] Int. Cl.[6] ..... B08B 7/04

[52] U.S. Cl. ..... 15/312.1

[58] Field of Search ..... 15/312.1, 312.2

[56] References Cited

U.S. PATENT DOCUMENTS

| | | | |
|---|---|---|---|
| 3,138,818 | 6/1964 | Black | 15/312.1 |
| 3,304,571 | 2/1967 | Black | 15/312.2 |
| 3,408,682 | 11/1968 | Black | 15/312.1 |
| 4,121,317 | 10/1978 | Sohlewr | 15/312.2 |
| 4,198,726 | 4/1980 | Powell, Jr. | |
| 4,360,432 | 11/1982 | Kieronski | |
| 4,572,748 | 2/1986 | House | 15/312.2 X |
| 5,345,649 | 9/1994 | Whitlow | |

*Primary Examiner*—Chris K. Moore
*Attorney, Agent, or Firm*—Adams Law Firm, P.A.

[57] ABSTRACT

An air director for balancing air flow during a perpendicular change in air flow direction, comprising a frame defining an outer perimeter and having an inner annular opening therein, a plurality of air-directing vanes positioned on the frame between the perimeter and the annular opening thereof in spaced-apart relation around the perimeter thereof for directing air therethrough from the perimeter and perpendicularly through the annular opening, the vanes positioned on the frame with opposed, major, air-directing surfaces defining a extended line having a predetermined angular offset relative to the radii of the annular opening for swirling the air.

21 Claims, 6 Drawing Sheets

TEXTILE CLEANING MACHINE WITH HIGH-EFFICIENCY AIR CIRCULATION

TECHNICAL FIELD AND BACKGROUND OF THE INVENTION

This invention relates to a traveling textile cleaner, particularly a textile cleaning machine of the type disclosed in U.S. Pat. No. 4,697,298. In such a device, a traveling cleaner unit moves along an endless rail suspended over a textile machine to be cleaned. The traveling cleaner unit includes blower nozzles for directing cleaning air against parts of the textile machine, such as a loom or spinning frame, or the like, and vacuum nozzles to pick up waste and transport it to a waste canister. Periodically the waste canister must be emptied. The traveling cleaner is docked to a unloading station so that the contents of the waste canister can be unloaded.

The cleaner operates on the principle of circulating air through a system which vacuums waste off of the floor and entrains it in the moving air stream, passes it through a filter to remove waste entrained in the moving air stream, and then directs it through a number of nozzles which are aimed at various parts of the textile machine from which waste is to be removed. This waste is blown into the floor, where it is vacuumed up, as described above, thus continuing the cycle. The air is moved by a high-speed fan positioned in the air stream.

It has been determined through extensive testing that inefficiencies result from design features which impede air flow, create imbalances in air pressure in the system, place varying loads on system components, increase noise, and thus increase power consumption. In the traveling air cleaner disclosed in this application as the preferred and enabling embodiment of the invention, the fan, fan motor and associated components are located in a relatively low-profile housing. The fan is the type having a solid disc carrying radially-extending fan blades on one surface which apply centrifugal energy to the air stream and thus direct the air stream radially-outwardly in all directions. This construction permits the motor and fan components to be contained in a much lower-profile housing than would be the case with a fan of the type providing axial air flow.

However, the corresponding disadvantage of this arrangement is that the air is directed at the fan from a single direction and at an angle essentially parallel to the plane of the fan rotation. This causes heavy loading on some fan blades and much lower loading on other blades.

The invention claimed in this application provides a highly efficient fan arrangement which achieves significantly improved performance with no increase in power consumption.

SUMMARY OF THE INVENTION

Therefore, it is an object of the invention to provide an efficient air director.

It is another object of the invention to provide an air director and fan assembly for a traveling textile cleaner.

It is another object of the invention to provide an air director for a traveling textile cleaner which has no wear-producing parts which require additional maintenance or part replacement.

It is another object of the invention to increase the efficiency of the fan and fan motor of the textile cleaner by directing air into the fan blades of the blower fan in the direction of fan blade rotation.

These and other objects of the present invention are achieved in the preferred embodiments disclosed below by providing an air director for balancing air flow during a perpendicular change in air flow direction, comprising a frame defining an outer perimeter and having an inner annular opening therein, a plurality of air-directing vanes positioned on the frame between the perimeter and the annular opening thereof in spaced-apart relation around the perimeter thereof for directing air therethrough from the perimeter and perpendicularly through the annular opening, the vanes positioned on the frame with opposed, major, air-directing surfaces defining a extended line having a predetermined angular offset relative to the radii of the annular opening.

According to one preferred embodiment of the invention, the air-directing vanes are positioned on the frame in uniformly spaced-apart relation to each other.

According to another preferred embodiment of the invention, the frame has an annular perimeter concentric with the annular opening therein. The air-directing vanes define an angle which cuts an arc through the annular opening.

According to yet another preferred embodiment of the invention, the air-directing vanes are positioned no less than 20 degrees apart and no more than 60 degrees apart.

Preferably, the air-directing vanes are positioned 30 degrees part around the perimeter of the frame.

Preferably, each of the air-directing vanes is positioned at a 45 degree angle to a radius touching the air director at its closest point to the annular opening.

According to yet another preferred embodiment of the invention, the frame comprises first and second frame segments positioned in parallel and axially spaced-apart relation to each other to define a perimetrical air-flow space therebetween, and wherein the air directing vanes are positioned between and engage the first and second frame segments perpendicular thereto.

An air filtration machine embodiment of the invention comprises a motor-driven fan for creating a moving air stream, a vacuum inlet in air-flow communication with the fan for directing the moving air downstream to the fan, and a blower outlet in air-flow communication with the fan for receiving the moving air stream and directing the moving air downstream to and out of the blower outlet under positive pressure. Filtration means are interposed in the air stream upstream of the blower outlet and downstream of the blower inlet for separating matter entrained in the moving air stream from the moving air stream. An air director is provided for delivering the moving air stream in a balance condition to the fan, and comprises a frame defining an outer perimeter and having an inner annular opening therein, a plurality of air-directing vanes positioned on the frame between the perimeter and the annular opening thereof in spaced-apart relation around the perimeter thereof for directing air therethrough from the perimeter and perpendicularly through the annular opening. The vanes are positioned on the frame with opposed, major, air-directing surfaces defining a extended line having a predetermined angular offset relative to the radii of the annular opening.

According to one preferred embodiment of the invention, the air-directing vanes are positioned on the frame in uniformly spaced-apart relation to each other.

According to yet another preferred embodiment of the invention, the frame has an annular perimeter concentric with the annular opening therein. The air-directing vanes define an angle which cuts an arc through the annular opening.

According to yet another preferred embodiment of the invention, the air-directing vanes are positioned no less than 20 degrees apart and no more than 60 degrees apart.

Preferably, the air-directing vanes are positioned 30 degrees part.

Preferably, each of the air-directing vanes is positioned at a 45 degree angle to a radius touching the air director at its closest point to the annular opening.

According to yet another preferred embodiment of the invention, the frame comprises first and second frame segments positioned in parallel and axially spaced-apart relation to each other to define a perimetrical air-flow space therebetween. The air directing vanes are positioned between and engage the first and second frame segments perpendicular thereto. In an embodiment of the invention comprising a traveling, rail-mounted overhead cleaner for cleaning textile processing machines and adjacent floor areas, the invention includes a cleaner chassis, drive means for moving the cleaner along the rail, fan means for generating an air flow, conduit means cooperating with the fan means for applying the air flow to areas to be cleaned, a waste canister cooperating with the conduit means for receiving and retaining accumulated waste therein, an unloading station for unloading waste accumulated by the cleaner, and an electrical circuit means for controlling the movement of the traveling cleaner around its cleaning circuit and to and from the unloading station. The improvement according to the invention comprises an air director for balancing air flow during a perpendicular change in air flow direction, comprising a frame having an outer perimeter and having an inner annular opening therein, a plurality of air-directing vanes positioned on the frame between the perimeter and the annular opening thereof in spaced-apart relation around the perimeter thereof for directing air therethrough from the perimeter and perpendicularly through the annular opening, the vanes positioned on the frame with opposed, major, air-directing surfaces defining a extended line having a predetermined angular offset relative to the radii of the annular opening.

According to one preferred embodiment of the invention, the air-directing vanes are positioned on the frame in uniformly spaced-apart relation to each other.

According to another preferred embodiment of the invention, the frame has an annular perimeter concentric with the annular opening therein. The air-directing vanes define an angle which cuts an arc through the annular opening.

According to yet another preferred embodiment of the invention, the air-directing vanes are positioned no less than 20 degrees apart and no more than 60 degrees apart.

Preferably, the air-directing vanes are positioned 30 degrees part around the perimeter of the frame.

Preferably, each of the air-directing vanes is positioned at a 45 degree angle to a radius touching the air director at its closest point to the annular opening.

According to yet another preferred embodiment of the invention, the frame comprises first and second frame segments positioned in parallel and axially spaced-apart relation to each other to define a perimetrical air-flow space therebetween, and wherein the air directing vanes are positioned between and engage the first and second frame segments perpendicular thereto.

An embodiment of the method of balancing air flow during a perpendicular change in air flow direction according to the invention comprises the steps of directing an moving air stream downstream against a frame defining an outer perimeter and having an inner annular opening therein and directing the moving air stream past a plurality of air-directing vanes positioned on the frame between the perimeter and the annular opening thereof in spaced-apart relation around the perimeter thereof and perpendicularly through the annular opening in the downstream direction. The vanes are positioned on the frame with opposed, major, air-directing surfaces defining a extended line having a predetermined angular offset relative to the radii of the annular opening.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
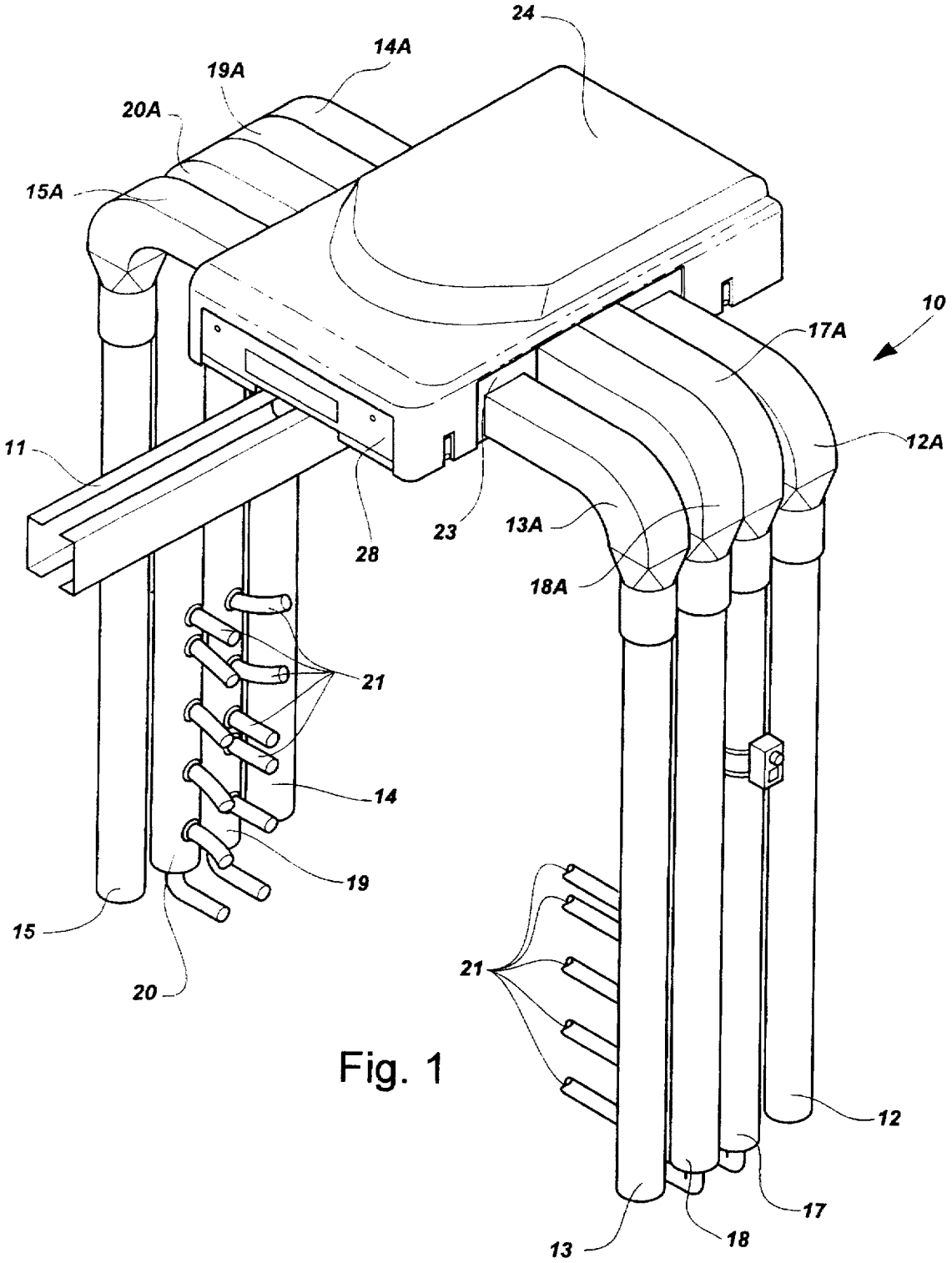
FIG. 1 is a perspective view of a traveling textile cleaner according to an embodiment of the present invention.

Referring now specifically to the drawings, a traveling cleaner according to the present invention is illustrated in FIG. 1 and shown generally at reference numeral 10. The traveling textile cleaner 10 is mounted for motorized movement along an overhead rail 11, and straddles rows of textile machines to be cleaned. Systems of the general type described may be configured to travel continuously in the same direction or to reverse direction and move back along a path just traversed in the opposite direction, depending on the rail arrangement. The traveling textile cleaner 10 includes two pairs of outboard vacuum legs 12,13 and 14,15 which are open at the bottom and which vacuum lint and other waste off of the floor. The traveling textile cleaner 10 also includes two pairs of inboard blower legs 17,18, and 19,20. The blower legs 17–20 are equipped with a series of nozzles 21 which communicate with the blower legs 17–20 and direct pressurized cleaning air against the textile machines as the traveling textile cleaner 10 passes by. The nozzles 21 are arranged by length, size and position to direct air against specific points on the machines. Of course, different sizes, numbers and positions of nozzles can be selected depending on the particular type of machine being cleaned.

The traveling textile cleaner 10 also includes a chassis 23 which is normally covered by a cover 24. Vacuum ducts 12*a*–15*a* and blower ducts 17*a*–19*a* extend out from the chassis 23 and interconnect with the vacuum legs 12–15 and blower legs 17–20, respectively.

Figure 2:
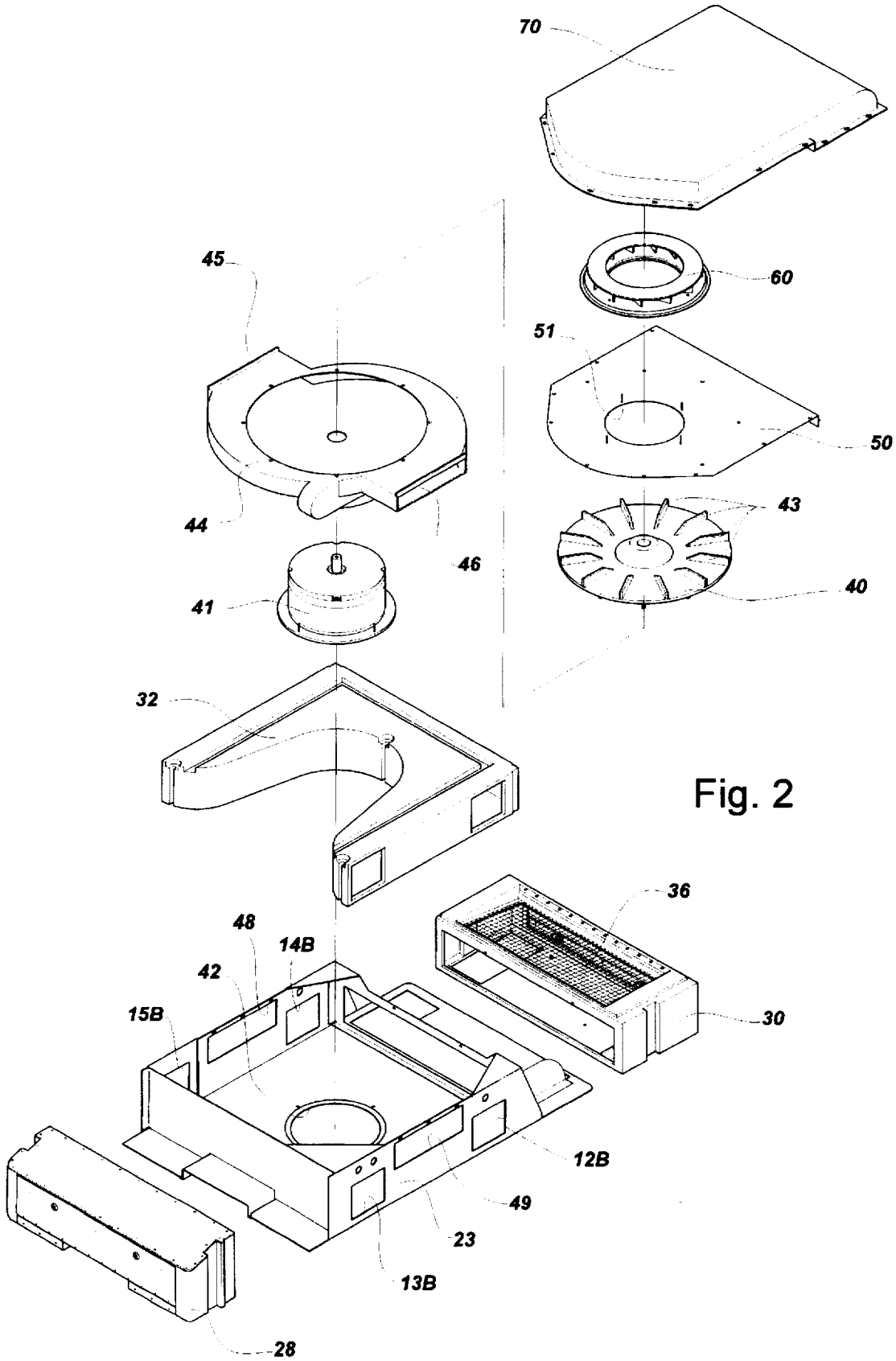
FIG. 2 is a fragmentary exploded view of the cleaner unit of the traveling textile cleaner shown in FIG. 1.

Referring now to FIG. 2, the traveling textile cleaner 10 is moved along the rail 11 by a drive motor (not shown)

housed under the cover 24. A control panel 28, which houses the electrical and electronic control components, is mounted on one end of the chassis 23. A waste canister 30 is mounted on the other end of chassis 23.

Waste is fed from the vacuum ducts 12A–15A to an inlet duct housing 32 mounted in the chassis 23 and which communicates with waste duct inlets 12B, 13B, 14B and 15B, respectively. the air stream laden with entrained particulate matter passes into the waste canister 30 and out through a wire mesh filter screen 36 in the top of the waste canister 30. The wire mesh screen 36 divides the waste canister 30 into upstream and downstream portions. Waste is collected on the upstream side of the filter screen 36 to form an overlying layer of particulate matter, while air in which the waste was entrained passes through the filter screen 36 from the upstream to the downstream side and continues out of the waste canister 30.

Air exiting the waste canister 30 is pressurized by fan 40, which is powered by a five (5) horsepower, three phase, 2 pole alternating current motor 41 operating at 3,600 rpm (nominal). Of course, different types and sizes of motors may be used based upon consideration of the usual operating criteria. Motor 41 is mounted on the floor of the chassis 23 in a motor mounting hole 42.

The fan 40 is a flat, disc-type fan which has a plurality of integrally-formed blades 43 which project upwardly into the airstream. This is opposite to the blades on the fan disclosed in applicant's U.S. Pat. No. 5,345,649, where the blades projected downwardly towards the motor 41. The fan 40 is cast of aluminum and is dynamically balanced to reduce vibration and noise, and to decrease stress on the motor 41.

The fan 40 is surrounded by a blower scroll 44 which fits over and around the fan 40. As the air is moved by the fan centrifugally outwardly, the shape of the blower scroll 44 permits a smooth, efficient acceleration and outward movement of the air without undue turbulence. Air exits the blower scroll 44 through outlets 45 and 46. Outlets 45 and 46 mate with the blower ducts 19A, 20A and 17A, 18A, respectively, through ports 48, 49 in the opposite sides of chassis 23.

A base plate 50 fits onto the top of the blower scroll 44 and encloses the top of the fan 40 and blower scroll 44.

An air director 60 according to the invention is positioned concentrically on top of the base plate 50 and communicates with the fan 40 through an opening 51 in the base plate 50. A duct cover 70 mounts to the top of the chassis 23 enclosing the above-described components and sealing the assembly against the passage of air except through the inlet and outlet ducts, described above. The cover 24 encloses the entire housing.

Further details regarding the docking and emptying of the waste canister can be found in U.S. Pat. No. 5,345,649, particularly at Col. 3, line 60 and following.

Figure 3:
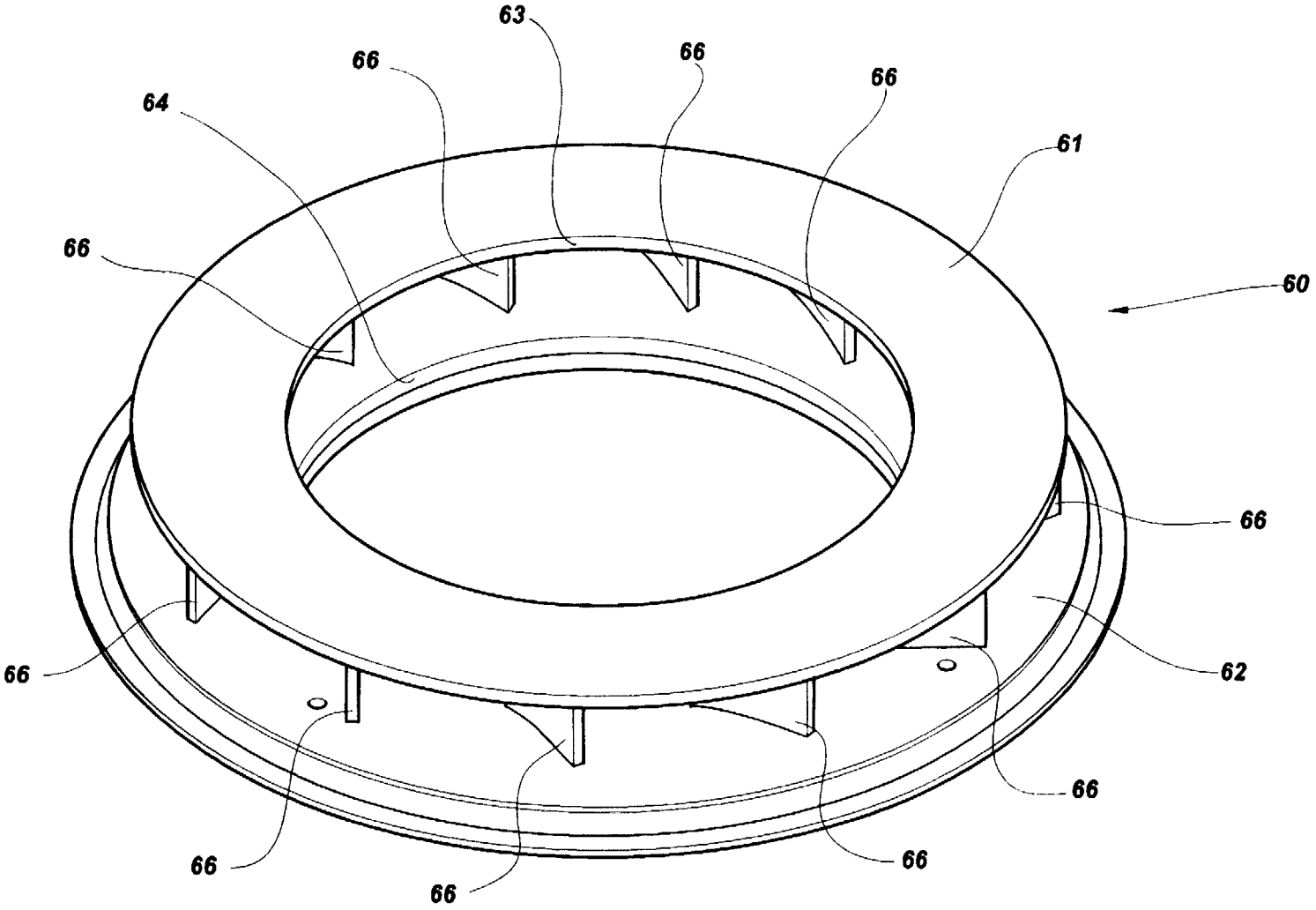
FIG. 3 is a perspective view of the air director according to an embodiment of the invention of the present application.

Referring now to FIG. 3, the air director 60 according to an embodiment of the invention is disclosed in more detail. air director 60 is formed of two annular frame members 61 and 62, which define concentric circular openings 63 and 64, respectively. The major surfaces of the frame members 61 and 62 lie in parallel planes, and are thus parallel to and equidistant from each other at all points on the opposed major surfaces.

The frame members 61 and 62 of the air director 60 are supported in their respective positions by a series of vanes 66 which structurally support the frame member 61 in a vertically spaced-apart position from the frame member 62. As is generally shown in FIG. 3, the vanes 66 are positioned at a uniform angle to the radii of the frame members 61 and 62.

Figure 4:
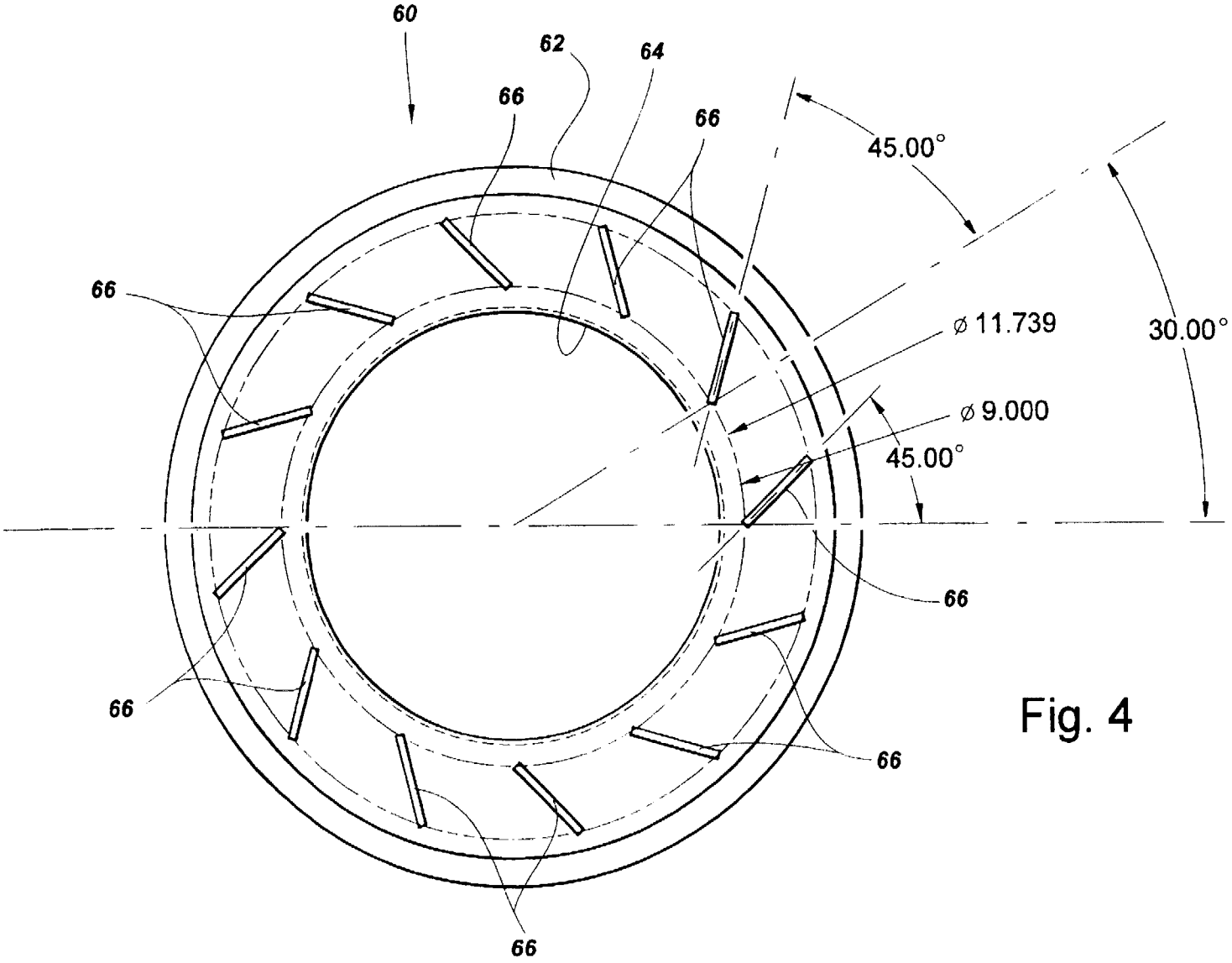
FIG. 4 is a top plan view of the air director shown in FIG. 3.

Referring now to FIG. 4, the arrangement of the vanes 66 according to a preferred embodiment of the invention is shown. Each vane 66 is positioned to define an angle of 45 degrees relative to a radius passing the inner leading edge of the vane 66. In the embodiment shown in FIG. 4, there are 12 vanes 66, equally spaced and therefore 30 degrees apart around the circumference of the air director 60.

Figure 5:
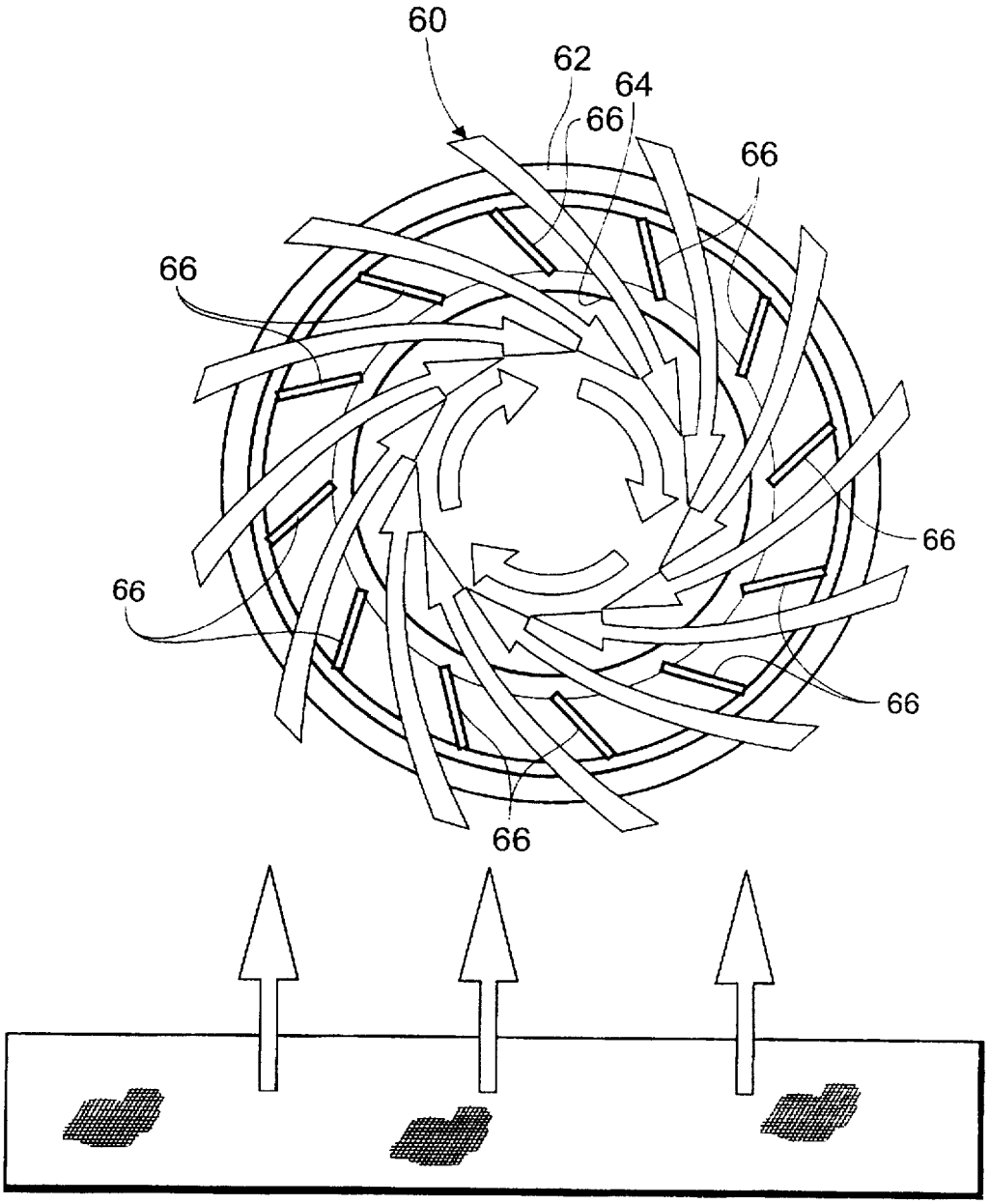
FIG. 5 is a top plan schematic view illustrating deflection of the air flow from the waste canister to the fan through the air director.

Referring now to FIG. 5, the action of the air director 60 is illustrated. Viewed from the top, motor 41 rotates the fan 40 in a clockwise direction. The vanes 66 on the air director 60 are angled to deflect the air passing out of the waste canister 30 into a generally clockwise direction as the air passes the vanes 66 and is drawn downwardly into contact with the blades 43 of the fan 40. The clockwise direction of the air substantially increases the efficiency of the motor 41 by using the air to add energy to the fan blades 43. The air is already moving in a clockwise direction and thus less energy is required to direct the air into the scroll 44. The vanes 66 thus create substantially equal air flow around the opening 51 in the base plate 50 through which the air is directed to the fan 40.

This is in distinct contrast to prior art systems, where the air is drawn directly into the fan housing in a straight line from the air inlet area. The air in such prior art devices engages the fan blades at the closest point of contact. Thus, one side of the fan nearest the point of entry of the air is heavily loaded with air, while the far side of the fan is relatively lightly loaded. In addition, the air engages the fan blades without any substantial rotational direction component. Thus, the fan has to work harder to change the direction of the air as it is accelerated centrifugally outward.

Figure 6:
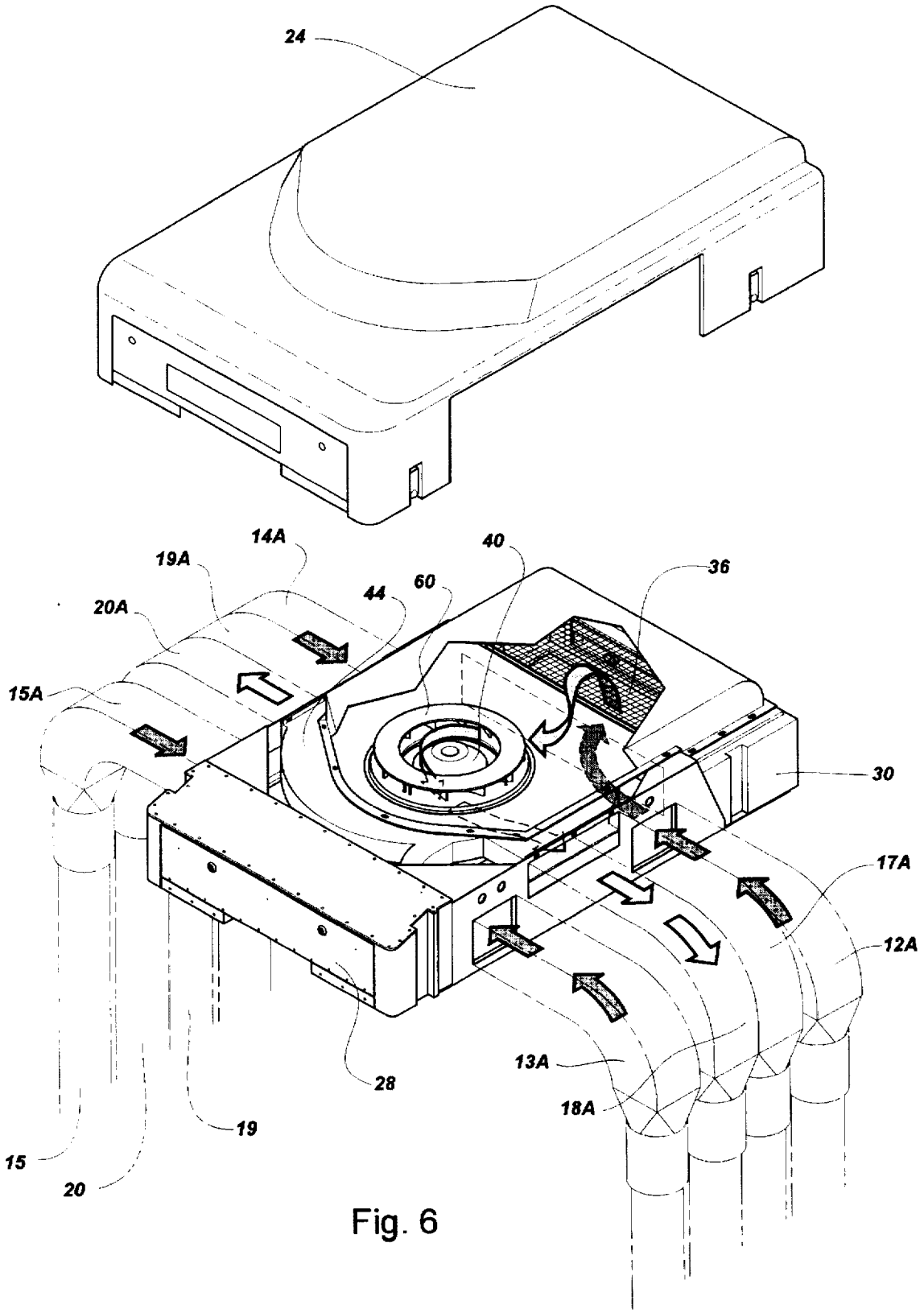
FIG. 6 is a fragmentary perspective view, with parts broken away, of the traveling textile cleaner according to an embodiment of the invention, showing the air flow through the machine.

Referring now to FIG. 6, the overall air flow of the textile cleaner 10 is illustrated. Air is propelled by the fan 40 into the scroll 44 and out through the outlets 45 and 46. The air is directed down through the blower ducts 17A–20A and into the blower legs 17–20. Air exits through the nozzles 21 and against the adjacent parts of the textile machine which is being cleaned.

Waste blown off of the textile machine settles towards the floor and is sucked into the vacuum legs 12–15. The air travels up the vacuum legs 12–15 and into the waste canister 30, where the waste material entrained in the moving air stream is collected on the upstream side of the filter screen 36. The air continues into the enclosure where the air director 60 is located. As illustrated in FIG. 5, the air is swirled clockwise by the vanes 66 of the air director 60 and is pulled by the negative air pressure created by the fan 40 into the scroll 44, where the process continues as described above.

The substantial improvement in efficiency which results from the use of the air director 60 is demonstrated in the following data, where tests were run using a prior art Luwa/Bahnson Parks/Cramer "Travclean", and a "Travclean" modified as described in this application, with reversed fan and scroll, modified inlet duct system, sealed inlet duct from canister screen to fan inlet, the air director 60 as described above, and with modified canister bulkhead and screen mounting, added motor cooling heat exchanger, motor cooling/track nozzle and pressurized cover. The same 5 HP motor 41 and fan 40 were used on both machines.

| | Prior Art Travclean | Modified Travclean |
|---|---|---|
| | Suction Performance Data | |
| Ducts 12–15 | 1276.4 CFM Total Vol.<br>Total Change = 36% | 1587.2 CFM Total Vol. |
| | Discharge Performance Data | |
| Ducts 17–20 | 1152.3 CFM Total Vol.<br>Total Change = 24.1% | 1336.0 CFM Total Vol. |

In the prior art data, the motor was over the rated amperage by 4 amps, causing an overrating of the motor HP to approximately 6 HP. In the Modified Travclean using the air director 60, the amperage dropped to 15, equal to 20% less HP, yet with efficiency improvements, as noted above.

Fan efficiency of the textile cleaner with the air director 60 is calculated as follows:

Fan Efficiency $$\text{Fan Bhp} = \frac{CFM \times TP}{6356}$$

$$TP = SP + VP = 9.0 + 2.48 = 11.48$$

$$CFM = 1587.2$$

$$\text{Fan Bhp} = \frac{1587 \times 11.48}{6356} = 2.87$$

$$\text{Fan Efficiency} = \frac{\text{Fan Bhp}}{\text{Motor HP}} \times 100 = \frac{2.87}{5.4} \times 100 = 53.2\%$$

Thus, the fan efficiency of the modified Travclean is over 50%.

Modifications other than incorporation of the new air director 60 into the system also account for efficiency improvements over the prior art cleaners. By comparing otherwise similar units with and without the air director 60 it was determined that the fan efficiency of the textile cleaner 10 improved from 46.9% to 53.2% as a result of the use of the air director 60.

An air director for a traveling textile cleaner is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

What is claimed is:

1. An air director for improving the efficiency of air flow during a change in air flow direction from a fan-induced radial-to-axial flow direction within a housing, comprising:

(a) a frame defining an outer perimeter and having an inner annular opening therein;

(b) a plurality of air-directing vanes cooperating with said frame between the perimeter and the annular opening in said frame in spaced-apart relation around the perimeter thereof for directing air between the vanes from the perimeter of the frame and perpendicularly through said annular opening in the frame;

(c) said vanes having opposed, major, air-directing surfaces defining an extended line having a predetermined angular offset relative to the radii of the annular opening.

2. An air director according to claim 1, wherein said air-directing vanes are in uniformly spaced-apart relation to adjacent ones of said vanes.

3. An air director according to claim 2, wherein said air-directing vanes are positioned no less than 20 degrees apart and no more than 60 degrees apart.

4. An air director according to claim 3, wherein said air-directing vanes are positioned 30 degrees part.

5. An air director according to claim 2, wherein each of said air-directing vanes is positioned at a 45 degree angle to a radius of said air director tangent to respective ones of said vanes at a closest point of said respective vanes to said annular opening.

6. An air director according to claim 1, wherein the frame has an annular perimeter concentric with the annular opening therein, and further wherein said air-directing vanes define an angle which defines an arc through the annular opening.

7. An air director according to claim 1, wherein said frame comprises first and second frame segments positioned in parallel and axially spaced-apart relation to each other to define a perimetrical air-flow space therebetween, and wherein said air directing vanes are positioned between and engage said first and second frame segments perpendicular thereto.

8. An air filtration machine, comprising:

(a) a motor-driven fan for creating a moving air stream;

(b) a vacuum inlet in air-flow communication with said fan for directing the moving air downstream to said fan;

(c) a blower outlet in air-flow communication with said fan for receiving the moving air stream and directing the moving air downstream to and out of said blower outlet under positive pressure;

(d) filtration means interposed in said air stream upstream of said blower outlet and upstream of said blower inlet for separating matter entrained in said moving air stream from said moving air stream; and (e) an air director for delivering the moving air stream to the fan, and comprising:

(i) a frame defining an outer perimeter and having an inner annular opening therein;

(ii) a plurality of air-directing vanes cooperating with said frame between the perimeter and the annular opening thereof in spaced-apart relation around the perimeter of said frame for directing air from the perimeter of the frame and perpendicularly through said annular opening of the frame; and (iii) said vanes positioned on said frame with opposed, major, air-directing surfaces defining a extended line having a predetermined angular offset relative to the radii of the annular opening.

9. An air filtration machine according to claim 8, wherein said air-directing vanes are positioned on said frame in uniformly spaced-apart relation to adjacent ones of said vanes.

10. An air filtration machine according to claim 9, wherein said air-directing vanes are positioned no less than 20 degrees apart and no more than 60 degrees apart.

11. An air filtration machine according to claim 10, wherein said air-directing vanes are positioned 30 degrees part.

12. An air filtration machine according to claim 11, wherein each of said air-directing vanes is positioned at a 45 degree angle to a radius of said air director tangent to respective ones of said vanes at a closest point of said respective vanes to said annular opening.

13. An air filtration machine according to claim 8, wherein the frame has an annular perimeter concentric with the annular opening therein, and further wherein said air-directing vanes define an angle which defines an arc through the annular opening.

14. An air filtration machine according to claim 8, wherein said frame comprises first and second frame segments positioned in parallel and axially spaced-apart relation to each other to define a perimetrical air-flow space therebetween, and wherein said air directing vanes are positioned between and engage said first and second frame segments perpendicular thereto.

15. In a traveling, rail-mounted overhead cleaner for cleaning textile processing machines and adjacent floor areas, including a cleaner chassis, drive means for moving the cleaner along the rail, fan means for generating an air flow, conduit means cooperating with said fan means for applying the air flow to areas to be cleaned, a waste canister cooperating with said conduit means for receiving and retaining accumulated waste therein, an unloading station for unloading waste accumulated by the cleaner, and electrical circuit means for controlling the movement of the traveling cleaner around its cleaning circuit and to and from the unloading station, the improvement which comprises an air director for improving the efficiency of air flow during a change in air flow direction from a fan-induced radial-to-axial flow direction within a housing, (a) a frame defining an outer perimeter and having an inner annular opening therein and positioned in said conduit means upstream of said fan means and downstream of said waste canister;

(b) a plurality of air-directing vanes cooperating with said frame between the perimeter and the annular opening thereof in spaced-apart relation around the perimeter thereof for directing air therethrough from the perimeter of the frame and perpendicularly through said annular opening of the frame;

(c) said vanes having opposed, major, air-directing surfaces defining a extended line having a predetermined angular offset relative to the radii of the annular opening.

16. In an overhead cleaner according to claim 15, wherein said air-directing vanes are positioned in uniformly spaced-apart relation to adjacent ones of said vanes.

17. In an overhead cleaner according to claim 16, wherein the frame has an annular perimeter concentric with the annular opening therein, and further wherein said air-directing vanes define an angle which defines an arc through the annular opening.

18. In an overhead cleaner according to claim 16, wherein said air-directing vanes are positioned no less than 20 degrees apart and no more than 60 degrees apart.

19. In an overhead cleaner according to claim 18, wherein said air-directing vanes are positioned 30 degrees part.

20. In an overhead cleaner according to claim 16, wherein each of said air-directing vanes is positioned at a 45 degree angle to a radius touching said air director at its closest point to said annular opening.

21. In an overhead cleaner according to claim 20, wherein said frame comprises first and second frame segments positioned in parallel and axially spaced-apart relation to each other to define a perimetrical air-flow space therebetween, and wherein said air directing vanes are positioned between and engage said first and second frame segments perpendicular thereto.

* * * * *